US005568795A

United States Patent [19]

Robichaux et al.

[11] Patent Number: 5,568,795

[45] Date of Patent: Oct. 29, 1996

[54] SYSTEM AND METHOD FOR MODE SELECTION IN A VARIABLE DISPLACEMENT ENGINE

[75] Inventors: Jerry D. Robichaux, Lincoln Park; Bradley J. Hieb, Dearborn, both of Mich.

[73] Assignee: Ford Motor Company, Dearborn, Mich.

[21] Appl. No.: 444,165

[22] Filed: May 18, 1995

[51] Int. Cl.[6] ..... F02B 77/00

[52] U.S. Cl. ..... 123/198 F

[58] Field of Search ..... 123/198 F

[56] References Cited

U.S. PATENT DOCUMENTS

| | | | |
|---|---|---|---|
| 4,483,288 | 11/1984 | Ueno et al. | 123/198 F |
| 4,494,503 | 1/1985 | Danno et al. | 123/198 F |
| 5,190,017 | 3/1993 | Cullen et al. | 123/480 |
| 5,331,936 | 7/1994 | Messih et al. | 123/571 |
| 5,408,974 | 4/1995 | Lipinski et al. | 123/198 F |
| 5,431,139 | 7/1995 | Grutter et al. | 123/198 F |

OTHER PUBLICATIONS

Nonlinear Low Frequency Phenomenological Engine Modeling and Analysis, by B. K. Powell and J. A. Cook, Reprinted from Proceedings Of The 1987 American Control Conference, Minneapolis, MN, Jun. 10–12, 1987, pp. 332–340.

Internal Combustion Engine Fundamentals, by John B. Heywood, Copyright 1988 by McGraw–Hill, Inc., pp. 311–312.

Nissan NAPS–Z Engine Realizes Better Fuel Economy and Low $NO_x$ Emission, by Masanori Harada, Tadashi Kadota, and Yoshitaka Sugiyama, SAE Technical Paper Series 810010, Feb. 23, 1981, pp. 13–15.

"4, 6, 8 . . . Which Cylinder Shall We Operate?", *Motor*, Jun. 25, 1983, pp. 52–53.

D. Stojek and D. Bottomley, "The Ford 3×6 Engine", Proceedings IMech vol. 198D, No. 15.

G. Berta, M. Troilo, "Cylinder Shut–off and Pressure Charging for Lower Fuel Consumption", SAE 82072.

K. Schellman and W. Schmid, "Possibilities by Saving Fuel by Switching Off Cylinders", Fuel Economy Research Conference, Unknown data & location.

T. Fukui, T. Nakagami, H. Endo, T. Katsumoto and Y. Danno, "Mitsubishi Orion–MD, A New Variable Displacement Engine," SAE 831007.

B. Bates, J. Dosdall and D. Smith, "Variable Displacement by Engine Valve Contol", SAE Paper 780145, 1978.

*Primary Examiner*—Noah P. Kamen
*Attorney, Agent, or Firm*—Neil P. Ferraro

[57] ABSTRACT

A system for selecting the operating mode of a variable displacement engine includes a vacuum analyzer, a flow analyzer, and a controller for determining whether the variable displacement engine should be operated on a fractional number of cylinders. The vacuum analyzer generates a vacuum recommendation signal indicating whether a fractionally operating variable displacement engine can accommodate the inferred desired fractional manifold vacuum with respect to a desired torque and a specific emissions calibration. The flow analyzer generates a flow recommendation signal indicating whether a fractionally operating variable displacement engine can accommodate a desired mass air flow and a desired exhaust gas recirculation flow with respect to a desired torque, a specific emissions calibration, and environmental conditions. The controller evaluates the vacuum and flow recommendation signals no determine the operating mode of the engine.

6 Claims, 8 Drawing Sheets

SYSTEM AND METHOD FOR MODE SELECTION IN A VARIABLE DISPLACEMENT ENGINE

FIELD OF THE INVENTION

The present invention relates to a system for determining when to operate less than the maximum possible number of cylinders of a multi-cylinder variable displacement engine, and, more particularly, to utilizing inferred desired manifold vacuum, mass air flow, and exhaust gas recirculation flow to make this determination.

DESCRIPTION OF THE RELATED ART

Automotive vehicle designers and manufacturers have realized for years that it is possible to obtain increased fuel efficiency by operating an engine on less than its full complement of cylinders during certain running conditions. Accordingly, at low speed, low load operation, it is possible to save fuel by operating, for example, an eight cylinder engine on only four or six cylinders, or a six cylinder engine on only three or four cylinders. In fact, one manufacturer offered a 4-6-8 variable displacement engine several years ago.

Also, Ford Motor Company designed a six cylinder engine which was capable of operating on three cylinders. While never released for production, Ford's engine was developed to a highly refined state. Unfortunately, both of the aforementioned engines suffered from deficiencies associated with their control strategies. Specifically, customer acceptance of the engine actually in production was unsatisfactory because the powertrain tended to "hunt" or shift frequently between the various cylinder operating modes. In other words, the engine would shift from four to eight cylinder operation frequently, producing noticeable torque excursions. This unfavorably caused the driver to perceive excessive changes in transmission gear in the nature of downshifting or upshifting. Additionally, prior art systems did not always consider whether the driver's demand for torque could be met by a fractionally operating engine before deciding to operate in fractional mode. Decisions were often based on direct measurements of real-time parameters, without considering how those parameters would be affected by fractional operation. Furthermore, prior art systems often did not properly account for engine emissions or mass air flow in deciding whether reduced cylinder operation was desirable or feasible.

U.S. patent application Ser. No. 08/400,066, filed Mar. 7, 1995, reflects an improvement to this earlier invention which utilizes inferred desired manifold pressure as a decision criteria. Additionally, U.S. patent application Ser. No. 08/444,341, filed simultaneously with the instant application by Ford inventors Robichaux and Hieb , now U.S. Pat. No. 5,503,129, increased the robustness of the system by accounting for the mass air flow and exhaust gas recirculation flow requirements associated with a driver's demanded torque in deciding whether to operate an engine on less than its full complement of cylinders. The present invention is directed at combining the decision criteria reflected in these two systems to decide whether to operate an engine on less than its full complement of cylinders.

SUMMARY OF THE INVENTION

A system for selecting the operating mode of a variable displacement engine includes vacuum analyzer, flow analyzer, and a controller for determining whether the variable displacement engine should be operated on a fractional number of cylinders. The vacuum analyzer generates a vacuum recommendation signal indicating whether a fractionally operating variable displacement engine can accommodate the inferred desired fractional manifold vacuum with respect to a desired torque and a specific emissions calibration. The flow analyzer generates a flow recommendation signal indicating whether a fractionally operating variable displacement engine can accommodate a desired mass air flow and a desired exhaust gas recirculation flow with respect to a desired torque, a specific emissions calibration, and environmental conditions. The controller evaluates the vacuum and flow recommendation signals to determine the operating mode of the engine.

A primary object of the present invention is to provide a new and improved system for determining when to operate less than the maximum possible number of cylinders of a multi-cylinder variable displacement engine. More specifically, it is an object of the present invention to utilize multiple criteria, including inferred desired manifold vacuum, mass air flow, and exhaust gas recirculation flow, to define the limits to such fractional operation.

A primary advantage of this invention is that it more directly addresses the driver's demand for torque and accounts for emissions requirements and environmental conditions in deciding whether to operate in fractional mode. An additional advantage is that the invention minimizes mode shifting by using inferred parameters as a basis for deciding whether to operate in fractional mode, so that decisions to switch modes are based on consistent computational methods. Yet another advantage is that the system can be adapted for a variety of engines by customizing and optimizing stored limit criteria and parameter weights for each particular application.

Other objects, features, and advantages will be apparent from a study of the following written description and drawings.

DETAILED DESCRIPTION OF THE PREFERRED EMBODIMENTS

Figure 1:
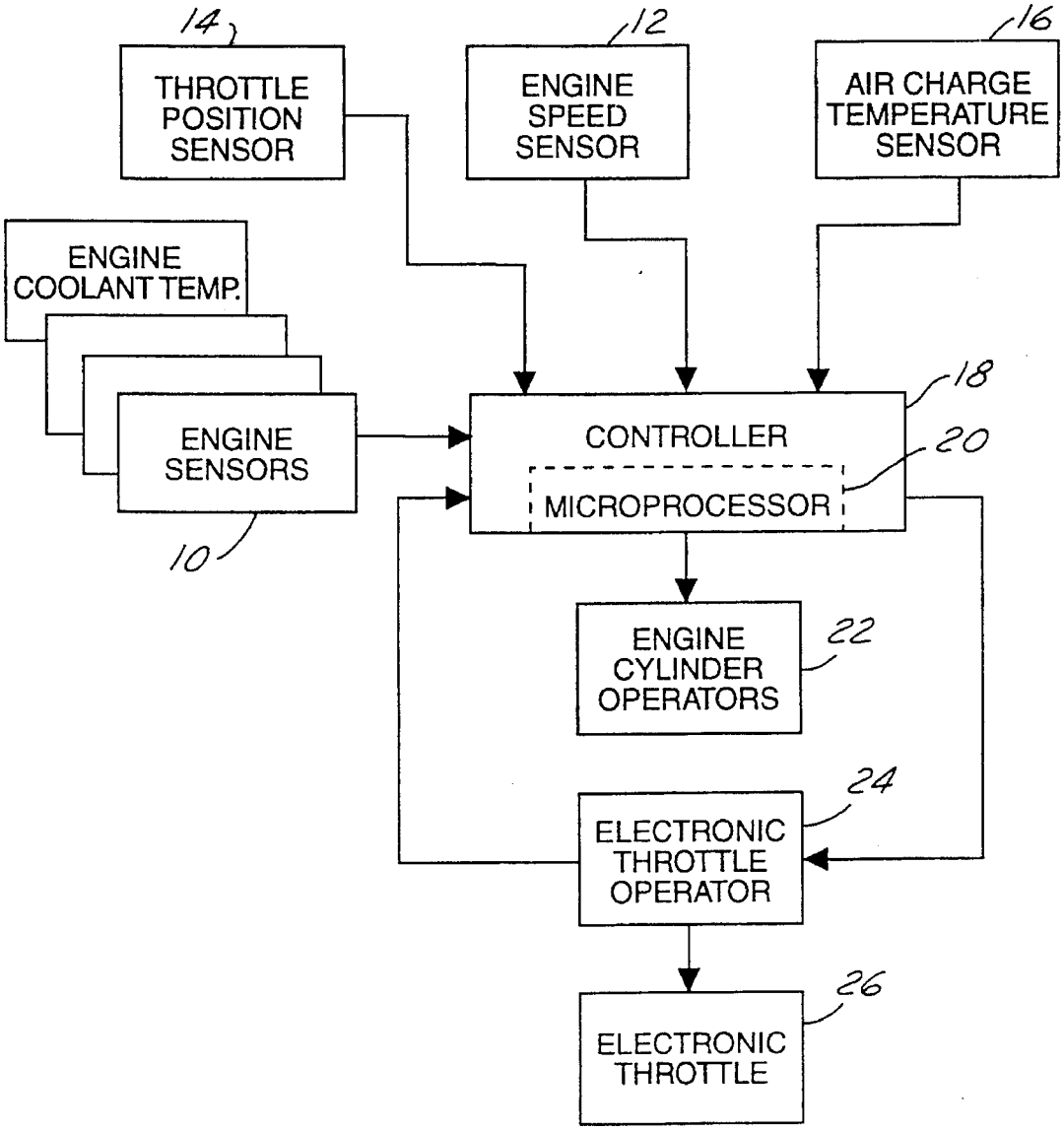
FIG. 1 is a block diagram of a variable displacement engine mode selection system according to the present invention.

Referring now to FIG. 1, a mode selection system for a variable displacement engine has an engine speed sensor 12 for sensing engine speed, a throttle position sensor 14 for sensing the position of one or more intake air throttles, an air charge temperature sensor 16 for measuring the temperature of air flowing into the engine, and additional assorted engine sensors 10 for measuring other engine characteristics and inferring the angle of the accelerator pedal controlled by the driver. Sensors 10, 12, 14, 16 provide signals to a controller 18 of the type commonly used for providing engine control.

Controller 18 includes a microprocessor 20 that utilizes input from various sensors such as sensors 10, 12, 14, and 16, which may include air charge temperature, engine speed, engine coolant temperature, and other sensors known to those skilled in the art and suggested by this disclosure. In addition to sensor input, microprocessor 20 also utilizes its own stored information (not shown), which may include limit values for various engine parameters or time-oriented data. Controller 18 may operate spark timing/control, air/fuel ratio control, exhaust gas recirculation (EGR), intake airflow, and other engine and power transmission functions. In addition, through a plurality of engine cylinder operators 22, controller 18 has the capability of disabling selected cylinders in the engine, causing the engine to have a decreased effective displacement. An engine operating with less than its full complement of cylinders is said to be in fractional mode, as opposed to maximum mode which utilizes all engine cylinders to provide maximum effective displacement. For example, with an eight-cylinder engine, controller 18 may operate the engine on three, four, five, six, seven, or eight cylinders, as warranted by the driver's demanded torque, a specific emissions calibration, and environmental conditions.

Those skilled in the art will appreciate in view of this disclosure that a number of different disabling devices are available for selectively rendering inoperative one or more engine cylinders. Such devices include mechanisms for preventing any of the cylinder valves in a disabled cylinder from opening, such that gas remains trapped within the cylinder.

Controller 18 operates electronic throttle operator 24, which may comprise a torque motor, stepper motor, or other type of device which positions an electronic throttle 26. Electronic throttle 26 is different from a mechanical throttle, which may be employed in connection with a manually operable accelerator control. The term maximum relative throttle position is used to refer to the cumulative restriction of the intake caused by whatever limits the control system has placed on the ability of the mechanical throttle and/or the electronic throttle to go wide-open. Electronic throttle operator 24 provides feedback to controller 18 regarding the position of the electronic throttle 26.

Figure 2:
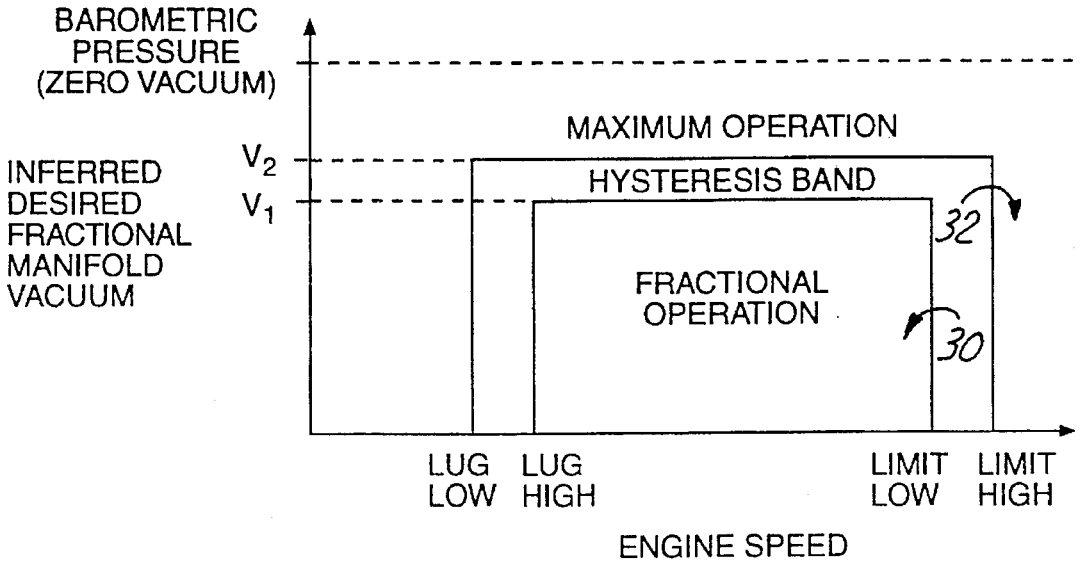
FIG. 2 illustrates an engine mode selection map for a preferred embodiment, where mode is a function of inferred desired fractional manifold vacuum, engine speed, and current engine operation.

As shown in the engine mode selection map of FIG. 2, one portion of the present invention utilizes inferred desired fractional manifold vacuum, engine speed, and the engine's current mode of operation in deciding whether to operate in fractional or maximum mode, with limit information being stored within the controller. This is called 'inferred desired fractional manifold vacuum analysis', or 'vacuum analysis' for short. Engine speed is shown on the horizontal axis. In a preferred embodiment, engine speed is expressed in RPM, with values increasing from left to right along the horizontal axis. For example, LUG LOW might represent 400 RPM, LUG HIGH might be 900 RPM, LIMIT LOW might be 2000 RPM, and LIMIT HIGH might be 2250 RPM.

Still referring to FIG. 2, inferred desired fractional manifold vacuum is shown on the vertical axis. Inferred desired fractional manifold vacuum is an estimate of the amount of manifold vacuum which would be desirable in a variable displacement engine operating on a fractional number of cylinders, given the driver's current demand for torque, present engine conditions, and accompanying emissions calibration, as dictated by spark timing and EGR concentration. In a preferred embodiment, inferred desired fractional manifold vacuum is expressed in inches of mercury, with $V_1$ representing, for example, four inches of mercury, and $V_2$ representing two inches of mercury. Moving from bottom to top along the vertical axis, vacuum decreases, equaling zero at the point where it matches current barometric pressure. Note that while $V_1$ and $V_2$ are shown as constants, they may also be linear or nonlinear functions, or even collections of irregular data values.

Fractional operation is recommended when the operating point which corresponds to the inferred desired fractional manifold vacuum and the engine speed is located within the inner area denoted FRACTIONAL OPERATION. Conversely, when the operating point is located in the outer area denoted MAXIMUM OPERATION, maximum mode is recommended. When the point is located within the area marked HYSTERESIS BAND, current engine mode is used to determine which combination of limits should be used, $V_1$/LUG HIGH/LIMIT LOW or $V_2$/LUG LOW/LIMIT HIGH. A fractional operation indicator stored within controller 18 of FIG. 1 is used to track current engine mode.

Referring again to FIG. 2, maximum-to-fractional arrow 30 indicates that the $V_1$/LUG HIGH/LIMIT LOW combination should be used when the engine is currently operating in maximum mode. Fractional-to-maximum arrow 32 indicates that the $V_2$/LUG LOW/LIMIT HIGH combination should be used when the engine is currently operating in fractional mode. This variability in limits provides a smoothing effect to reduce the likelihood of excessive mode switching.

For example, when the engine is first started, engine speed is less than LUG LOW, causing the engine to operate in the maximum mode according to the map. Because of the hysteresis band, a recommendation to operate in fractional mode will not be made until the engine speed is within the LUG HIGH/LIMIT LOW boundaries and the inferred desired fractional manifold vacuum is less than or equal to $V_1$. However, once the engine meets these criteria and begins to operate in fractional mode, it will continue this fractional operation until the engine speed falls outside the LUG LOW/LIMIT HIGH boundaries or the inferred desired fractional manifold vacuum exceeds $V_2$.

Figure 3:
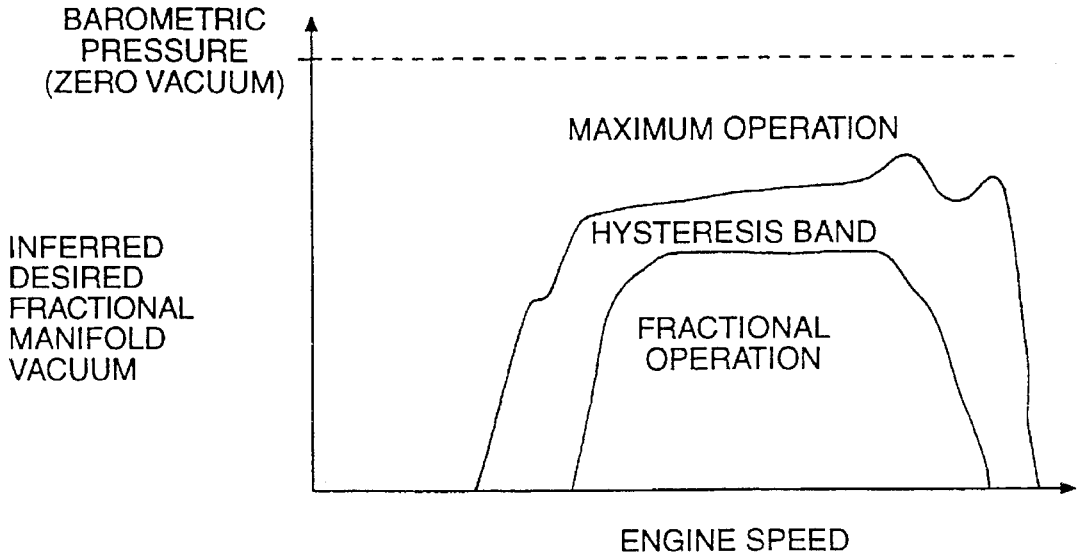
FIG. 3 illustrates an engine mode selection map for an alternative embodiment showing mode as nonlinear functions of inferred desired fractional manifold vacuum, engine speed, and current engine operation.

The engine mode selection map of FIG. 3 shows an alternative embodiment in which the preferred mode is established using nonlinear functions of inferred desired fractional manifold vacuum, engine speed, and current engine mode. Such functions might be derived based on operating characteristics of a particular engine, taking into account a variety of factors including emissions and powertrain features. As in FIG. 2, the vertical axis of FIG. 3 reflects inferred desired fractional manifold vacuum, which equals zero at barometric pressure and increases in a downward direction.

Figure 4:
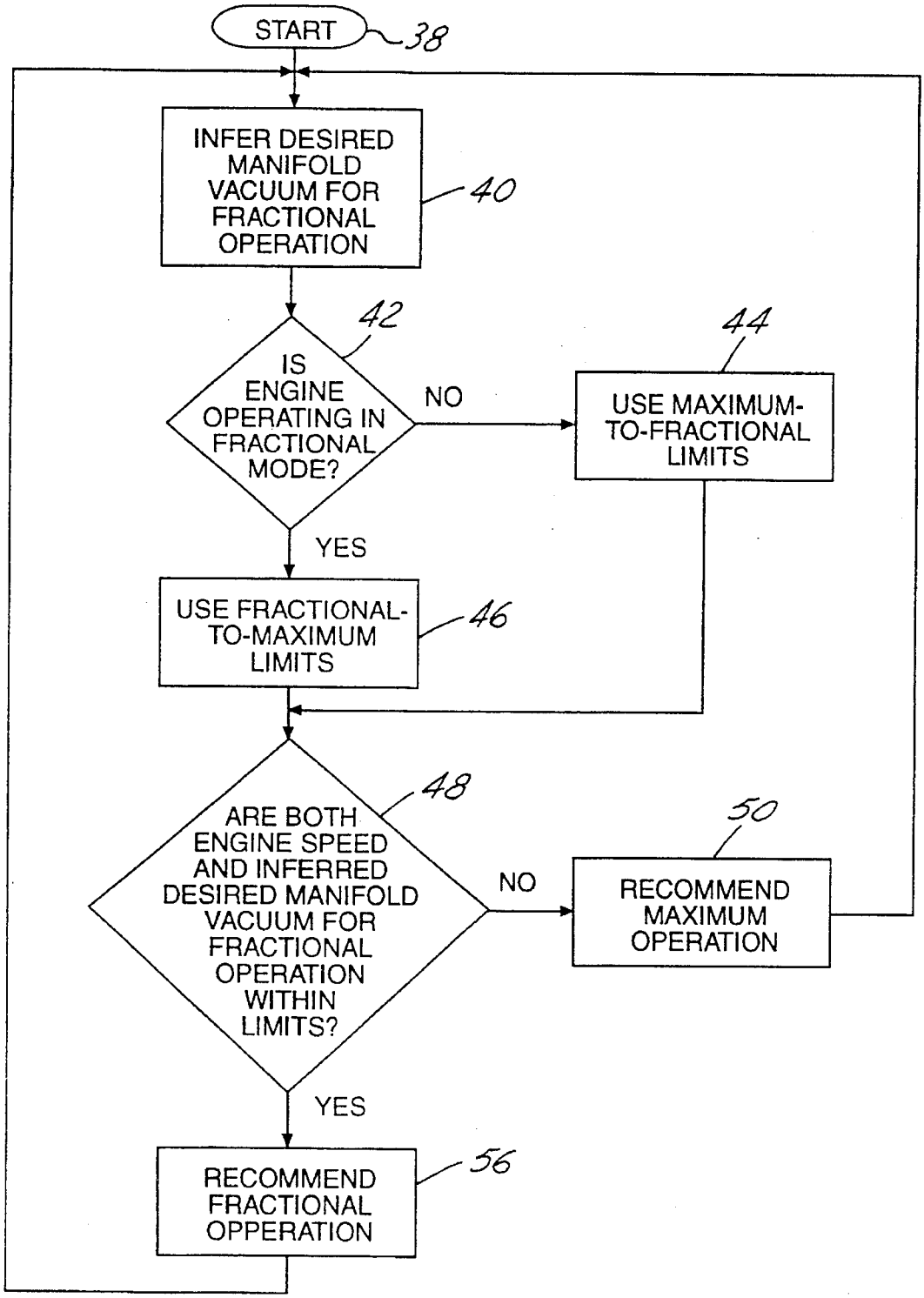
FIG. 4 is a flow chart of a preferred embodiment showing a mode selection process for a variable displacement engine utilizing inferred desired fractional manifold vacuum.

Turning now to FIG. 4, a preferred embodiment of the method for selecting the operating mode of a variable displacement engine begins at block 38 with the start of the program. At block 40, the controller infers a desired manifold vacuum for a fractionally operating engine which corresponds to the driver's current demand for torque, present engine conditions, and accompanying emissions calibration, as dictated by spark timing and EGR concentration. This inferred desired manifold vacuum is always determined based on a fractionally operating engine, independent of the engine's real-time operating state, hence the term inferred desired fractional manifold vacuum. Inferring the desired fractional manifold vacuum provides stable decision criteria throughout all operating modes, unlike measuring manifold vacuum, which reflects only the engine's current mode of operation. Inferred desired fractional manifold vacuum is important because it reflects an estimate of the manifold vacuum which the engine will have to achieve in order to operate successfully in fractional mode. If a fractionally operating engine would not be able to meet the driver's demanded torque and specific emissions calibration under the current engine and atmospheric conditions, which are reflected in the inferred desired fractional manifold vacuum, then maximum mode should be recommended. Those skilled in the art will recognize that various methods for inferring manifold vacuum may be chosen. It is the use of inferred desired fractional manifold vacuum as a decision criteria that forms the core of the present invention.

One example of a possible method for determining/inferring manifold absolute pressure is disclosed by Cullen et. al. in U.S. Pat. No. 5,190,017 at column 7, line 4 through column 7, line 15, which teaches the use of a simple regression analysis to infer manifold absolute pressure from vacuum. Determination of manifold vacuum is taught at column 7, lines 15—20. Another example is disclosed by Messih et. al. in U.S. Pat. No. 5,331,936 beginning at column 6, lines 1 through 40. Yet another example of determining manifold pressure is disclosed in a 1987 article by Powell and Cook, *Nonlinear Low Frequency Phenomenological Engine Modeling and Analysis* as published in the Proceedings of the 1987 American Control Conference, Jun. 10–12, 1987 held in Minneapolis, Minn., at page 335 (see first column). These documents are incorporated herein by reference.

Continuing with FIG. 4, at block 42 the controller checks the current engine mode to determine which engine map limits should be utilized. If the engine is currently in maximum mode, then maximum-to-fractional limits are used for engine speed and desired fractional manifold vacuum, as shown by block 44. If the engine is currently in fractional mode, then fractional-to-maximum limits are used for engine speed and desired fractional manifold vacuum, as shown by block 46. At block 48 the controller checks to ascertain whether both engine speed and inferred desired fractional manifold vacuum are within the selected limits defined by a stored engine mode selection map. If either engine speed or inferred desired fractional manifold vacuum are outside the defined limits, then maximum operation is recommended as shown at block 50, and the controller continues with block 40. If both are within the defined limits, then at block 56 the controller recommends fractional operation. The controller then continues with block 40.

Figure 5:
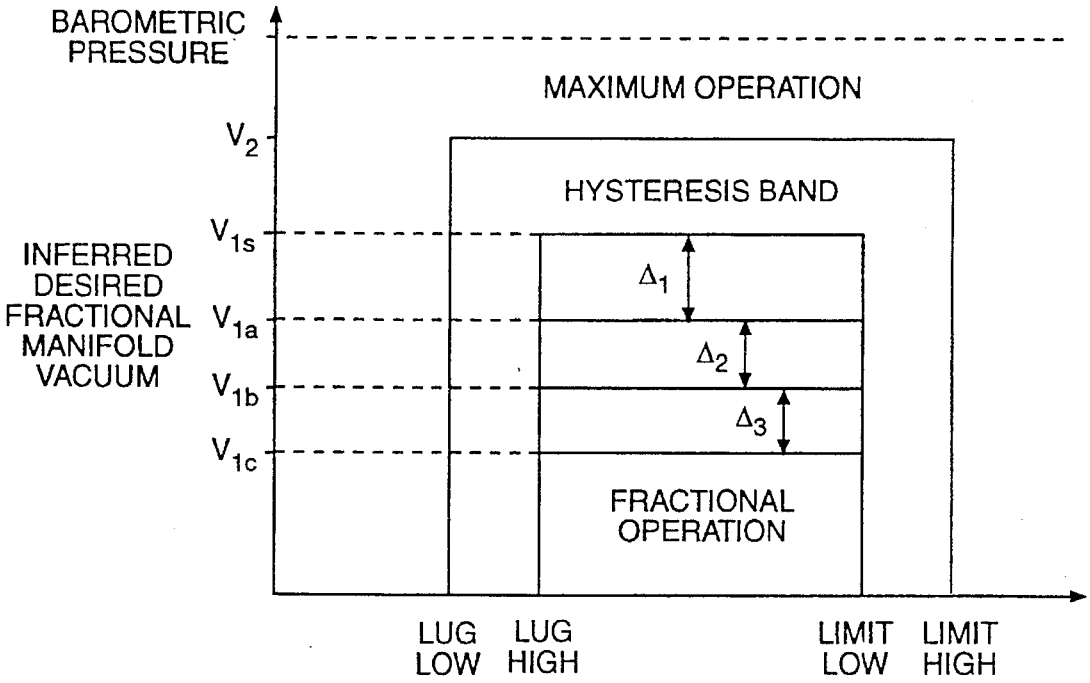
FIG. 5 illustrates an engine mode selection map for an alternative embodiment where an inferred desired fractional manifold vacuum limit is adjusted during the course of engine operation.

Turning now to FIG. 5, an engine mode selection map for an alternative embodiment of the present invention is fundamentally similar to that of FIG. 2 but includes a variable limit for the $V_1$ transition level of inferred desired fractional manifold vacuum, as represented by $V_{1s}$, $V_{1a}$, $V_{1b}$, and $V_{1c}$. The actual value selected for $V_1$ on a particular occasion may be a function of time or mode switching frequency, and the amount of variation as represented by $\delta 1$, $\delta 2$, and $\delta 3$ may change with current vehicle speed or other operating conditions. The system begins with $V_1$ set to the point $V_{1s}$ and changes this limit each time the engine changes modes, afterwards allowing $V_1$ to approach the predetermined static value as represented by $V_{1s}$. This dynamic limit for $V_1$ effectively widens the real-time hysteresis band for transitions into fractional mode, and it can be used to add stability and make transitions more smooth under particular environmental conditions where many transitions might ordinarily take place. While this embodiment adjusts the $V_1$ limit with every mode transition, less frequent changes may also be accomplished if desirable. Similarly, adjusting $V_2$ may also be desirable.

Figure 6:
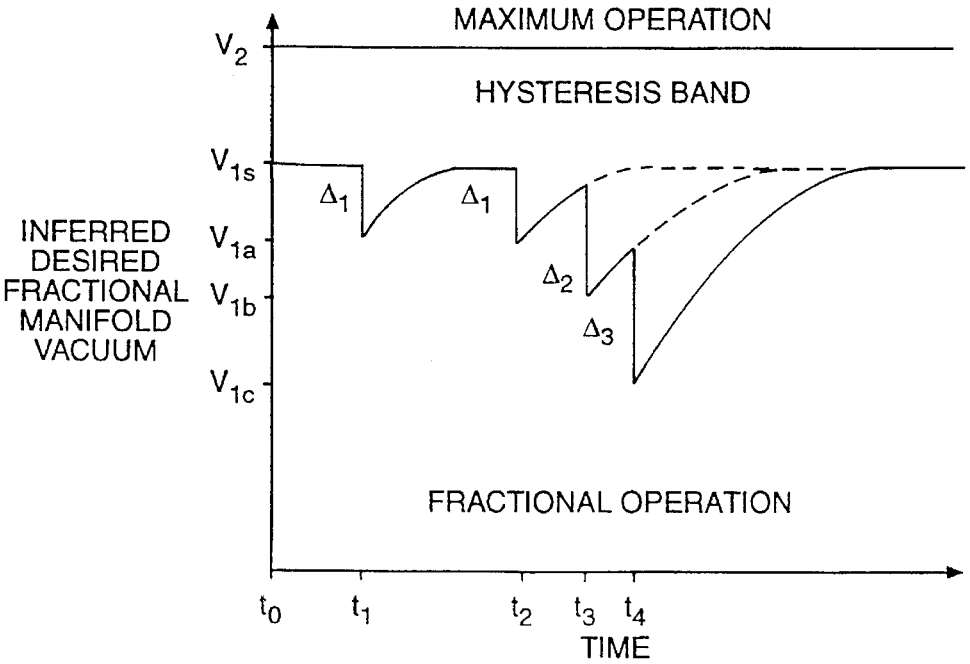
FIG. 6 is a timing diagram illustrating adjustments to an inferred desired fractional manifold vacuum limit over time.

Turning now to FIG. 6, a timing diagram illustrates an example of adjustments to an inferred desired fractional manifold vacuum limit over time. Time increases from left to right on the horizontal axis, and manifold vacuum decreases from bottom to top on the vertical axis. Inferred desired manifold vacuum limits $V_2$ and $V_{1s}$ initially define the hysteresis band as shown on the left at time $t_0$. At time $t_1$, a transition is made which causes the system to increase the vacuum limit $V_1$ by $\delta 1$, so it increases from $V_{1s}$ to $V_{1a}$. After the transition, the limit returns to the initial $V_{1s}$ value, using a restorative function of $e^{-t/\tau}$ where $\tau$ represents a time constant chosen by the system to achieve the desired smoothing effect. Note that while this preferred embodiment utilizes a restorative function of $e^{-t/\tau}$, other restorative functions may also be utilized. Note also that the time constant $\tau$ may be varied dynamically to permit faster or slower recovery as circumstances warrant.

Continuing with FIG. 6, at time $t_2$ another transition is made, causing the $V_1$ limit to be increased by $\delta 1$ to $V_{1a}$. For simplicity, this change has been drawn to mirror the change which took place at $t_1$, but this would not necessarily be true under actual operating conditions. Afterwards, the limit once again attempts to restore itself to the original value, but at $t_3$ another transition occurs before it can do so, causing the limit to be increased by $\delta 2$ to the value represented by $V_{1b}$.

Similarly, the subsequent attempt at restoring $V_1$ to the level of $V_{1s}$ is interrupted by yet another transition at $t_4$. This transition causes the limit to be increased by $\delta 3$ to a still larger vacuum represented by $V_{1c}$. Note that at this point, the hysteresis has been dramatically widened to reduce the frequency of transitions for smoother operation. Afterwards, the limit restores itself over time to the original value represented by $V_{1s}$.

Figure 7A:
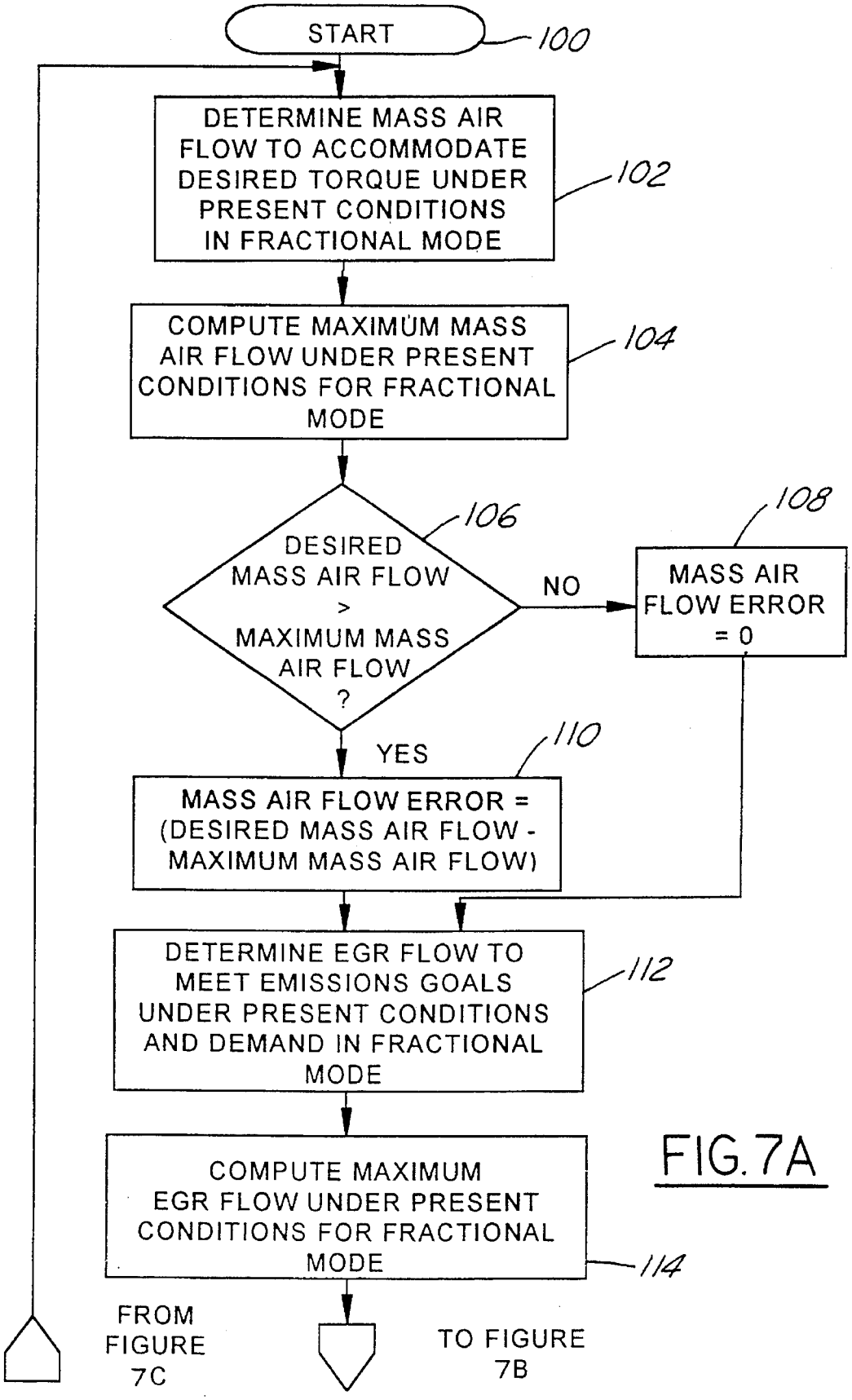
FIGS. 7*a*, 7*b*, and 7*c* are a flow chart of a preferred embodiment showing a mode selection process for a variable displacement engine utilizing mass air flow and exhaust gas recirculation flow.

Turning now to FIG. 7*a*, a preferred embodiment of a flow-based method for selecting the operating mode of a variable displacement engine begins at block 100 with the start of the cycle. At block 102 the system evaluates the mass air flow which would be necessary to operate the engine on a fractional number of cylinders (a "fractionally operating engine"), considering the driver's current torque demand. This quantity is known as the desired mass air flow. More specifically, it is the quantity of air per unit time that must flow into the operating cylinders to meet the demanded torque. Desired mass air flow is chiefly a function of the air charge per cylinder, the number of operating cylinders, and the number of engine rotations per minute. It can be computed by either inferring or measuring the aforementioned parameters, depending on the degree of precision desired, and then multiplying them together. In a preferred embodiment, the estimate also takes into account the specific emissions calibration of the engine.

One example of a method for determining air charge is disclosed by Powell & Cook, supra, at pages 335–336, in columns 1 and 2. Cullen et. al. in U.S. Pat. 5, 190,017 at column 3, lines 26 through 44, teaches how to calculate mass air flow given the air charge, RPM, and number of cylinders from the foregoing. Another example of calculating mass air flow is provided in the textbook by John B. Heywood, *Internal Combustion Engine Fundamentals,* copyrighted in 1988 and published by McGraw-Hill, Inc. (ISBN 0-07-028637-X), at pages 311–312 (see the first formula at the top of page 312). An example of determining specific emissions calibrations, or EGR requirements, for the engine, is taught by Masanori Harada et al. in *Nissan NAPS-Z Engine Realizes Better Fuel Economy and Low $NO_x$ Emission,* SAE Paper 810010, Feb. 23, 1981, at pages 13–15, which teaches that EGR is inferred as a function of load and RPM. Those skilled in this art will recognize immediately that EGR and spark are generally scheduled as tabular functions of RPM and load (with load being equal to actual air charge/maximum theoretical air charge). These documents are incorporated herein by reference.

At block 104 the system determines the maximum mass of air that can flow through a fractionally operating engine under present cylinder charging conditions. In a preferred embodiment, these conditions include barometric pressure and air charge temperature. They may also include maximum relative throttle position, depending on what throttle control hardware and/or strategy is being used. Barometric pressure is considered because as it decreases, the density of air decreases, resulting in less air mass for a fixed volume. This in turn reduces the mass air flow. For example, a vehicle operating at a high altitude, where barometric pressure is reduced, will have less maximum mass air flow than a vehicle operating under identical conditions but at a lower altitude. Note that barometric pressure can be measured directly or inferred from other data.

Similarly, the temperature of the air charge is considered in a preferred embodiment because it also affects the density of the air, which in turn impacts the maximum mass air flow. For example, warm air is less dense than cold air, so maximum mass air flow is greater an cooler temperatures. Note that air charge temperature can be measured directly or inferred from other data.

An example of a method for determining the temperature of the air charge is disclosed by Messih in U.S. Pat. No. 5,331,936, at column 4, line 63 through column 5, line 8. This document is incorporated herein by reference.

Relative throttle position may be considered in a preferred embodiment if the mechanical throttle and/or the electronic throttle are restricted from going wide-open for control purposes. Such a restriction within the passage through which the air reaches the engine can limit the maximum mass air flow, depending on what throttle control strategy is used. Note that a preferred embodiment represents this as a constant in the system strategy for simplification, but a variable signal could be utilized if desired.

While a preferred embodiment utilizes barometric pressure and air charge temperature to determine the maximum mass air flow for a fractionally operating engine, other signals could be used in addition to or in place of these, depending on the nature of the engine and the degree of precision required.

Continuing with FIG. 7*a*, at block 106 the system compares the desired mass air flow to the maximum mass air flow. If the desired mass air flow is smaller, then the system can accommodate the mass air flow requirement associated with operating in fractional mode, so the mass air flow error is set to zero at block 108. If the desired mass air flow exceeds the maximum mass air flow, then system cannot meet the mass air flow requirement associated with fractional operation. The mass air flow error is set to the amount by which the desired mass air flow exceeds the maximum mass air flow at block 110, and the system proceeds to investigate EGR flows.

Continuing with FIG. 7*a*, the system now determines at block 112 the flow of exhaust gas which must be recirculated to meet the predetermined emissions goals for a fractionally operating engine. For simplicity, a preferred embodiment uses some percentage of the desired mass air flow established earlier, but other methods are also acceptable.

The system then determines the maximum mass of exhaust gas that can be recirculated through a fractionally operating engine under present atmospheric conditions at block 114. In a preferred embodiment, the system uses barometric pressure, a desired manifold pressure associated with fractional operation, and the corresponding desired mass air flow required for fractional operation, but other means of calculating the maximum EGR flow could be used if desired. Barometric pressure is useful because as atmospheric pressure decreases, such as at high altitudes, less EGR can be accommodated without degrading engine performance. The thinner air at high altitude dictates that a greater percentage of fresh air, as determined by the desired mass air flow, is needed to maintain the proper air/fuel ratio.

Figure 7B:
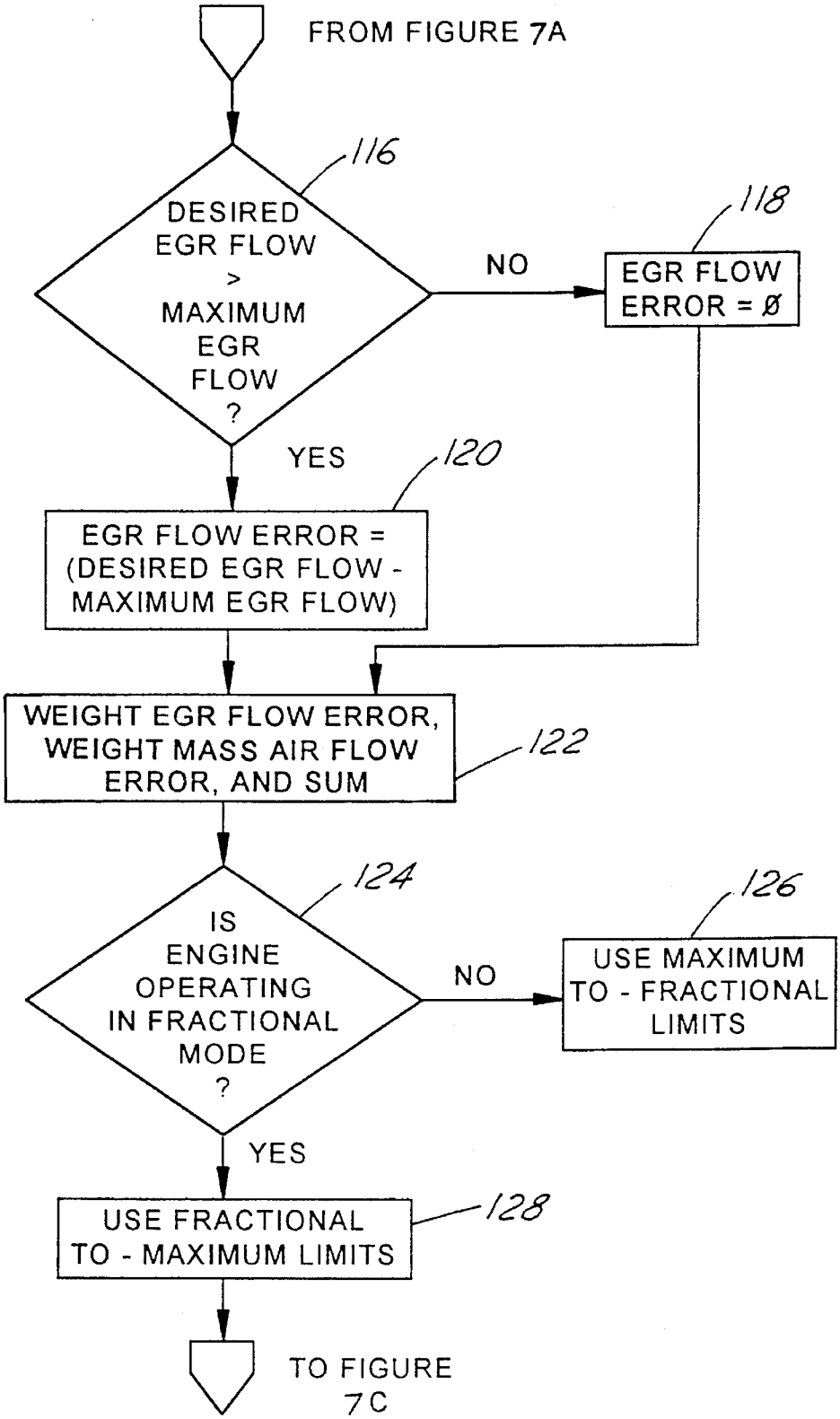

Turning now to FIG. 7*b*, the system continues by comparing the desired EGR flow to the maximum EGR flow at block 116. If the desired EGR flow does not exceed the maximum EGR flow at block 118, then the EGR flow error is zero. Otherwise, the EGR flow error equals that amount by which desired EGR flow exceeds maximum EGR flow at block 120.

The system next sums the mass air flow error with the EGR flow error at block 122. In a preferred embodiment, the system weights each flow error, multiplying it by a predetermined amount before summing. While this weighing is not essential, it does permit one flow error to count more significantly than the other, which may be desirable under some control strategies. Note also that the mass air flow error could be weighted earlier, such as immediately after it was computed, instead of at this point. It is shown here for simplicity's sake.

Continuing with FIG. 7*b*, a preferred embodiment next looks at whether the engine is presently operating on a fractional number of cylinders at block 124, so it may choose an error threshold. For an engine operating on the maximum number of cylinders, a maximum-to-fractional threshold is chosen at block 126, which indicates the maximum amount of acceptable flow error for which the system will recommend switching to fractional operation. For a fractionally operating engine, a fractional-to-maximum threshold is selected at block 128, which indicates the minimum amount of flow error for which the system will recommend a return to maximum operation. While a preferred embodiment utilizes a pair of error thresholds, greater or fewer thresholds could be used if desired. The dual error threshold arrangement of the present invention provides hysteresis by setting the fractional-to-maximum threshold higher than the maximum-to-fractional threshold, which reduces excessive mode switching that can arise with single threshold systems.

Figure 7C:
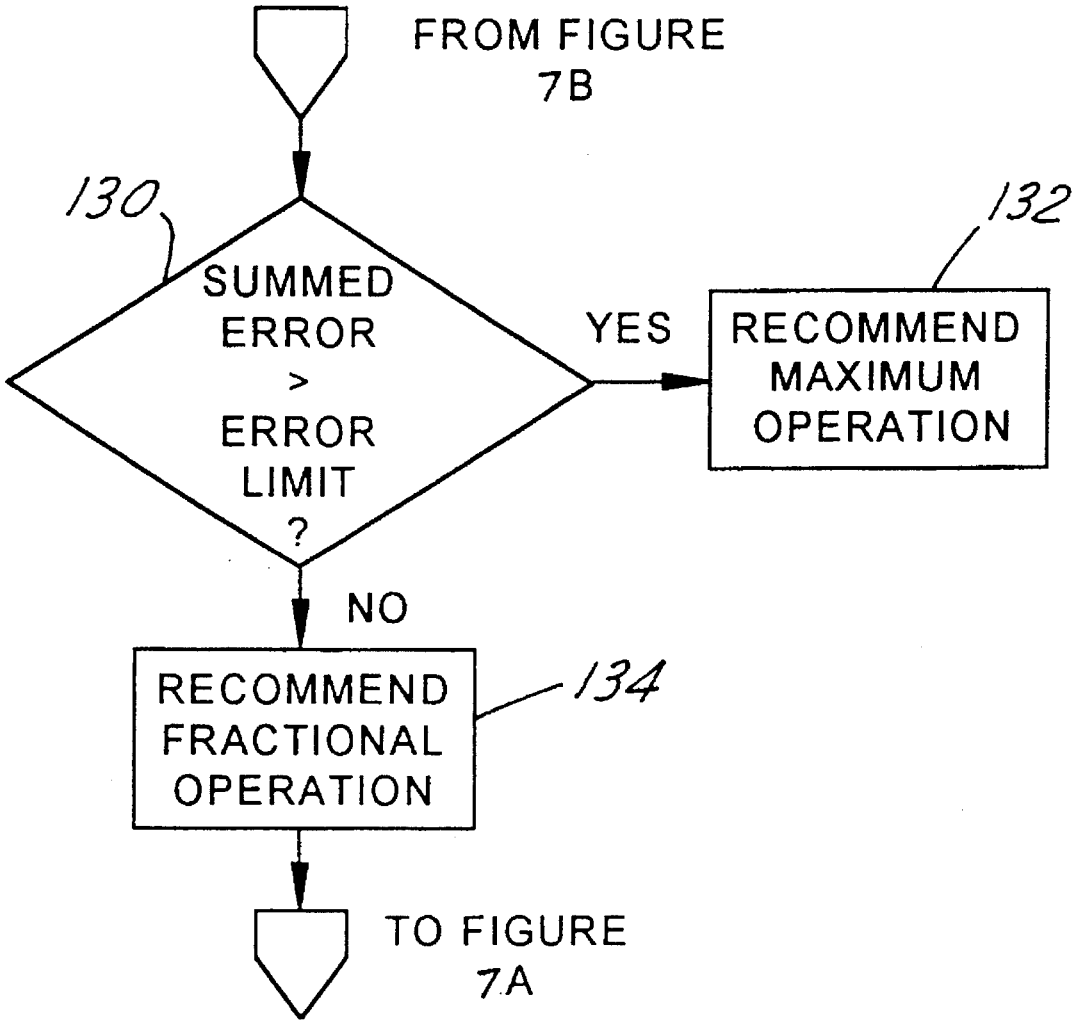

Turning now to FIG. 7*c*, the system compares the sum of the flow error with the selected error threshold at block 130. If the error exceeds the threshold at block 132, then the system recommends that the engine operate on its maximum number of cylinders, because the flow necessary to accommodate the desired torque cannot be met under present conditions and given the specific emissions calibration. If the error does not exceed the threshold at block 134, then the system recommends that the engine operate on a fractional number of cylinders.

Note that while either mass air flow or exhaust gas recirculation flow could be used by itself as a decision criteria, preferred embodiment utilizes both flows in making its recommendation of an operating mode to the engine. Utilizing both mass air flow and exhaust gas recirculation flow provides greater robustness in recommending an operating mode, especially since small errors in both flows may combine to alter the recommendation which might be made if each flow was analyzed by itself.

Figure 8:
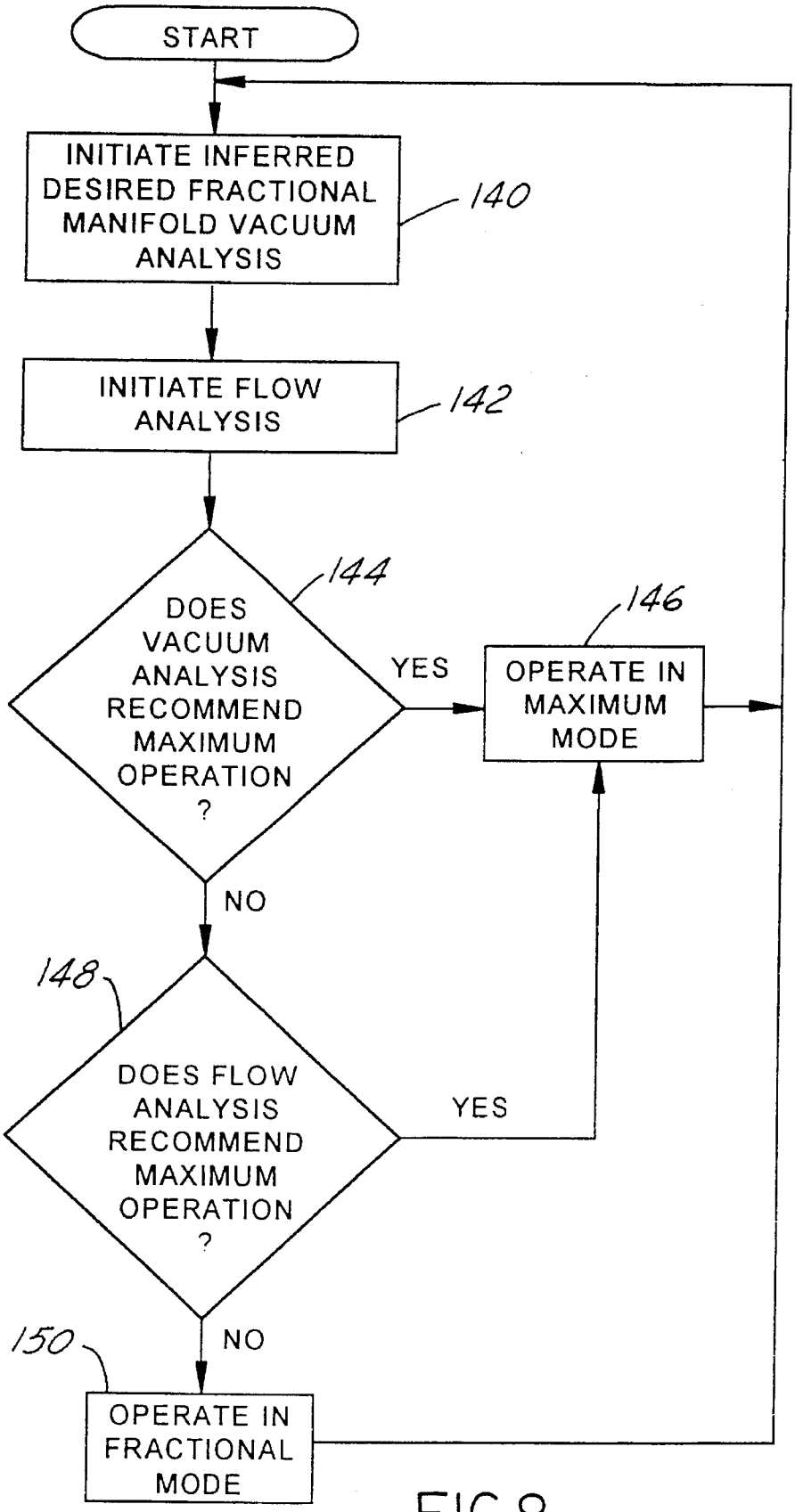
FIG. 8 is a flow chart of a preferred embodiment combining inferred desired fractional manifold vacuum analysis with flow analysis according to the present invention.

Turning finally to FIG. 8, a flow chart of a preferred embodiment combining inferred desired fractional manifold vacuum analysis with flow analysis according to the present invention is shown. The system begins by initiating an analysis of the inferred desired fractional manifold vacuum requirements at 140, the details of which were shown in FIG. 4. Continuing with FIG. 8, the system next initiates an analysis of the mass air flow and EGR flow requirements and constraints at 142, the details of which were shown in FIGS. 7A, 7B, and 7C. After completing these analyses, at 144 the system analyzes the results of each one in turn by checking first to see whether the vacuum analysis recommends operating on the maximum number of cylinders. If the vacuum analysis explained in steps 40 through 56 of FIG. 4 recommends the fractional mode of operation, then the process continues to step 148. If the vacuum analysis recommends maximum mode, then the system selects maximum mode operation at 146, completing its cycle.

If vacuum analysis does not recommend maximum mode, then the system checks to see what the flow analysis recommends at 148. If any one of the flow analysis steps 102 through 134 as illustrated in FIGS. 7A, 7B and 7C recommends operating on the maximum number of cylinders, then the system selects maximum mode operation at 146, completing its analysis. If, like the vacuum analysis, the flow analysis does not recommend maximum mode, then the system selects fractional mode at 150, completing its cycle. The cycle continues at timed intervals, but it could also be initiated by specific irregular events if desirable. Also, a plurality of predetermined numerical weights, such as those described in FIG. 7B at 122, could be utilized to permit tradeoffs between recommendations if desired. Note that the thrust of the invention is not the method by which the vacuum or the flows are calculated, nor the sequence in which parameter calculations are initiated. Rather, it is the combination of these parameters as criteria in deciding the appropriate number of cylinders for operating a variable displacement engine.

For simplicity, additional decision criteria have not been shown on the flow chart of FIG. 8. However, other parameters, both measured and inferred, may be directly or indirectly taken into consideration in deciding the number of cylinders upon which to operate. More specifically, it is preferable to directly consider vehicle speed and engine coolant temperature and to indirectly consider engine speed in the decision-making process. This assures smoother operation consistent with the driver's demanded torque under the specific emissions calibration. Additionally, both vehicle speed and engine coolant temperature could be used as numeric limits further defining the boundaries of fractional operation. For example, fractional operation might be prohibited when the engine coolant temperature indicates that the engine is cold, or when the vehicle is traveling at a high rate of speed. Similarly, engine speed can be used directly, such as limiting fractional operation when the engine is turning slowly, or indirectly, as was shown in FIG. 2.

From the foregoing description, one ordinarily skilled in the art can easily ascertain the essential characteristics of this invention and, without departing from the spirit and scope of the claims, can make various changes and modifications to the invention to adapt it to various usages and conditions.

We claim:

1. A system for determining a number of cylinders to operate in an internal combustion variable displacement engine, the system comprising:

a processor, coupled to said engine, for determining whether the variable displacement engine should be operated on a fractional number of cylinders, with said processor inferring a desired fractional manifold vacuum for a half displacement mode when said engine is in any displacement mode; generating a vacuum recommendation signal representative of the variable displacement engine operating on the fractional number of cylinders, with the desired fractional manifold vacuum representing a vacuum that would produce a desired torque and desired emissions as if the variable displacement engine were operating on the fractional number of cylinders; inferring a desired mass air flow and a desired exhaust gas recirculation flow; and, generating a flow recommendation signal representative of the variable displacement engine operating on the fractional number of cylinders, with the desired mass air flow representing a mass air flow that would produce the desired torque and the desired emissions as if the variable displacement engine were operating on the fractional number of cylinders, and with the desired exhaust gas recirculation flow representing an exhaust gas recirculation flow that would produce the desired torque and the desired emissions as if the variable displacement engine were operating on the fractional number of cylinders; wherein said processor controls the operation of the variable displacement engine responsive to said vacuum recommendation signal and said flow recommendation signal both being within predetermined ranges for enabling the operation on the fractional number of cylinders.

2. A system according to claim 1 wherein said processor estimates engine speed, generates an engine speed recommendation signal responsive to the engine speed being within a predetermined range throughout which the variable displacement engine can operate on a fractional number of cylinders, infers engine coolant temperature and generates a temperature recommendation signal responsive to the engine coolant temperature being within a predetermined range throughout which the variable displacement engine can operate on a fractional number of cylinders; and, wherein said processor controls the operation of the variable displacement engine for operating on the fractional number of cylinders when both said speed recommendation and temperature recommendation signals are within their respective predetermined ranges.

3. A system according to claim 1 wherein said processor multiplies each of said vacuum recommendation signal and said flow recommendation signal by one of a plurality of predetermined numerical weights.

4. A method of determining a number of cylinders to operate in an internal combustion variable displacement engine, comprising the steps of:

inferring a desired fractional manifold vacuum for the half displacement mode when said engine is in any displacement mode representing a vacuum that would produce a desired torque and desired emissions as if the variable displacement engine were operating on the fractional number of cylinders at a current engine speed and generating a vacuum recommendation signal representative of the variable displacement engine operating on the fractional number of cylinders;

inferring a desired mass air flow representing a desired mass air flow that would produce the desired torque and the desired emissions as if the variable displacement engine were operating on the fractional number of cylinders and generating a mass air recommendation signal representative of the variable displacement engine operating on the fractional number of cylinders;

inferring a desired exhaust gas recirculation flow representing an exhaust gas recirculation flow that would produce the desired torque and the desired emissions as f the variable displacement engine were operating on the fractional number of cylinders and generating an exhaust gas recirculation recommendation signal representative of the variable displacement engine operating on the fractional number of cylinders; and operating the variable displacement engine on the fractional number of cylinders responsive to the vacuum recommendation signal, the mass air recommendation signals and the exhaust gas recirculation recommendation signal each being within predetermined ranges required for the engine to operate in the fractional displacement mode.

5. A system for selecting the number of cylinders to be operated in a multicylinder variable displacement internal combustion engine installed in a vehicle, comprising:

a processor, coupled to said engine, for determining whether the variable displacement engine should be operated on a fractional number of cylinders, with said processor inferring a desired fractional manifold vacuum for a half displacement mode when said engine is in any displacement mode; generating a vacuum recommendation signal representative of the variable displacement engine operating on the fractional number of cylinders, with the desired fractional manifold vacuum representing a vacuum that would produce a desired torque and desired emissions as if the variable displacement engine were operating on the fractional number of cylinders; inferring a desired mass air flow and a desired exhaust gas recirculation flow; and, generating a flow recommendation signal representative of the variable displacement engine operating on the fractional number of cylinders, with the desired mass air flow representing a mass air flow that would produce the desired torque and the desired emissions as if the variable displacement engine were operating on the fractional number of cylinders, and with the desired exhaust gas recirculation flow representing an exhaust gas recirculation flow that would produce the desired torque and the desired emissions as if the variable displacement engine were operating on the fractional number of cylinders; with said processor containing stored values for engine torque as a function of engine speed, fractional manifold vacuum, mass air flow, and exhaust gas recirculation flow at full torque demand for fractional displacement operation, with said processor receiving said vacuum recommendation signal, said mass air flow recommendation signal, and said exhaust gas recirculation recommendation signal and responsive thereto determining demanded engine torque, with said processor comparing the demanded engine torque with stored values for full torque limits in the fractional displacement mode at the same engine speed, and for selecting the number of cylinders to be operated based at least in part on said comparison.

6. A system as described in claim 5 wherein said processor selects the fractional displacement mode of operation for the internal combustion engine responsive to said vacuum recommendation signal, said mass air flow recommendation signal, and said exhaust gas recirculation recommendation signal, each being less than the corresponding stored values for full torque limits in the fractional displacement mode.

* * * * *